US006430816B2

(12) United States Patent
Neveux

(10) Patent No.: US 6,430,816 B2
(45) Date of Patent: Aug. 13, 2002

(54) BLADE LOCKING MECHANISM

(75) Inventor: Yves Neveux, Sainte Croix Vallée Françoise (FR)

(73) Assignee: Mentor Group, LLC, Oregon City, OR (US)

( * ) Notice: Subject to any disclaimer, the term of this patent is extended or adjusted under 35 U.S.C. 154(b) by 0 days.

(21) Appl. No.: 09/271,010

(22) Filed: Mar. 17, 1999

(30) Foreign Application Priority Data

Mar. 18, 1998 (FR) ..... 98 03508

(51) Int. Cl.[7] ..... B26B 3/06
(52) U.S. Cl. ..... 30/161; 30/155; 30/158
(58) Field of Search ..... 30/151, 155, 158, 30/159, 160, 161

(56) References Cited

U.S. PATENT DOCUMENTS

| | | | | | |
|---|---|---|---|---|---|
| 1,701,027 | A | | 2/1929 | Brown | |
| 2,705,832 | A | | 4/1955 | Mirando | 30/159 |
| 3,930,309 | A | * | 1/1976 | Collins | 30/161 |
| 4,133,106 | A | | 1/1979 | Addis | 30/160 |
| 4,148,140 | A | | 4/1979 | Lile | 30/161 |
| 4,240,201 | A | | 12/1980 | Sawby et al. | 30/161 |
| 4,274,200 | A | | 6/1981 | Coder | 30/161 |
| 4,535,539 | A | | 8/1985 | Friedman et al. | 30/161 |
| 4,551,917 | A | * | 11/1985 | Walker | 30/161 |
| 4,604,803 | A | | 8/1986 | Sawby | 30/161 |
| 4,837,932 | A | | 6/1989 | Elsener | 30/161 |
| 4,974,323 | A | | 12/1990 | Cassady | 30/155 |
| 5,060,379 | A | | 10/1991 | Neely | 30/161 |
| 5,293,690 | A | * | 3/1994 | Cassady | 30/161 |
| 5,425,175 | A | * | 6/1995 | Rogers | 30/161 |
| 5,442,855 | A | * | 8/1995 | Jobin | 30/161 |
| 5,511,310 | A | * | 4/1996 | Sessions et al. | 30/161 |
| 5,581,834 | A | * | 12/1996 | Collins | 30/158 |
| 5,615,484 | A | * | 4/1997 | Pittman | 30/161 |
| 5,685,079 | A | * | 11/1997 | Brothers et al. | 30/161 |
| 5,815,927 | A | * | 10/1998 | Collins | 30/161 |
| 5,839,194 | A | * | 11/1998 | Bezold | 30/161 |
| 5,915,792 | A | * | 6/1999 | Sakurai | 30/161 |
| 6,105,255 | A | * | 8/2000 | Cheng | 30/161 |

* cited by examiner

*Primary Examiner*—M. Rachuba
(74) *Attorney, Agent, or Firm*—Chernoff, Vilhauer, McClung & Stenzel, LLP

(57) ABSTRACT

A folding tool (14, 60) including a locking mechanism for keeping a knife blade (2, 72) or other tool blade in an extended position or a folded position with respect to a handle (1, 62). A locking body (3, 90, 90', 142, 150, 162) extending between the sides (16, 18, 64, 68) of the handle (1, 62) is moveable transversely, between a locking position and a releasing position. A flat locking face (42, 102) of the locking body (3, 90) engages a flat engagement surface (44, 104) on the blade (2, 72) when the blade is in the extended position. A ball detent including a projecting ball surface (98) and a mating detent cavity (112) may be used to keep the blade in its folded position with respect to the handle. Another detent includes inclined surfaces (128, 132).

42 Claims, 5 Drawing Sheets

BLADE LOCKING MECHANISM

TECHNICAL FIELD

This invention relates to a locking mechanism for a blade of a folding knife or for a similar tool that can be folded and opened either manually or automatically.

BACKGROUND ART

Traditionally, the blade of a folding knife or similar tool is locked in an open, extended position by a mechanism included in the knife or other folding tool. One such mechanism includes a circular cylindrical retaining peg, or cross-bolt, urged by a spring into a position in which the cross-bolt prevents the blade from folding, by engagement of a wide diameter portion of the cross-bolt against the surface of a cut-out portion of the base of the blade. By pressing an end of the cross-bolt the user moves it so that the wide diameter portion is disengaged and moves into a recess in the handle, giving the base of the blade clearance to rotate past a smaller-diameter portion of the cross-bolt. Because of the dimensions of the large diameter portion of such a cross-bolt, this mechanism requires a large hole to be cut into the blade to receive the cross-bolt. Such a hole reduces the strength of the blade. Furthermore, such a mechanism is not very robust, since it engages a part of the blade that is located close to the spindle about which the blade rotates between its folded and its opened position.

What is desired, then, is a mechanism for locking a folding blade of a tool such as a knife in an open position without requiring a hole in the blade where it might weaken the blade.

DISCLOSURE OF THE INVENTION

The blade locking mechanism for a folding knife according to the present invention overcomes the aforementioned disadvantage of locking mechanisms utilizing a cylindrical cross-bolt, yet maintains a similar working principle. A first aspect of a locking mechanism according to the present invention is that at least a portion of a locking body is a flat-sided body mounted to be moveable laterally within a handle and urged toward a locking position by a spring included in the handle of the knife or other folding tool, hereinafter referred to for convenience as a folding knife. The locking body has such a shape that when the locking body is moved laterally of the handle to a releasing position, the base of the blade can pass the locking body to move about a blade pivot axis between an open or extended position and a closed or folded position.

In one preferred embodiment of the locking mechanism according to the present invention the locking body is in the form of a modified flat bar slidably fitted in a pair of slots or holes defined in the sides of a handle of the knife, so that a flat surface of the locking body can engage a flat surface on the base of the knife blade when the locking body is moved laterally by a spring included in one of the handles of the knife.

In one preferred embodiment of the invention a laterally-projecting stop member is carried on a portion of the blade and extends from the blade into an opening defined in one of the sides of the handle. The stop is located so as to engage a surface defining the opening in the handle, at positions limiting the range of movement of the blade about its pivot axis, so that the projecting stop member contacting the surface defining the opening, and the locking body contacting a surface of the blade, together prevent the blade from moving in either direction about its pivot axis.

In another embodiment of the invention a surface of a base portion of the blade may be brought to bear against a fixed abutment portion of the handle to prevent movement of the blade about the blade pivot axis in one direction, while the locking body is urged into contact against another surface of the blade and prevents the blade from moving in the opposite direction about the pivot axis.

In one embodiment of the invention a first surface of the locking body bears against one surface of the blade to keep the blade in an opened, extended position, and a different surface of the locking body bears against a different surface of the blade to retain the blade in its closed, folded position with respect to the handle.

The foregoing and other objectives, features, and advantages of the invention will be more readily understood upon consideration of the following detailed description of the invention, taken in conjunction with the accompanying drawings.

BEST MODES FOR CARRYING OUT THE INVENTION

Figure 1:
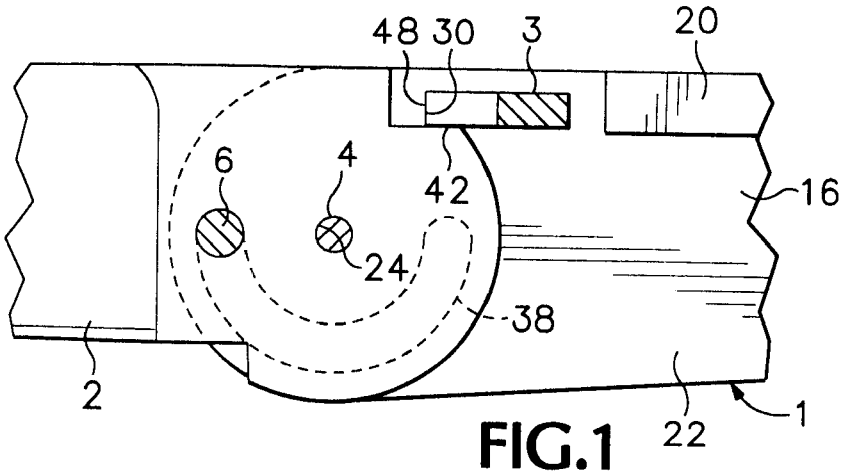
FIG. 1 is a section view of a portion of a folding knife, taken along the line I—I in FIG. 3 and showing a locking mechanism which is one embodiment of the present invention holding a blade of the knife in an open, or extended, position with respect to the handle.
Figure 2:
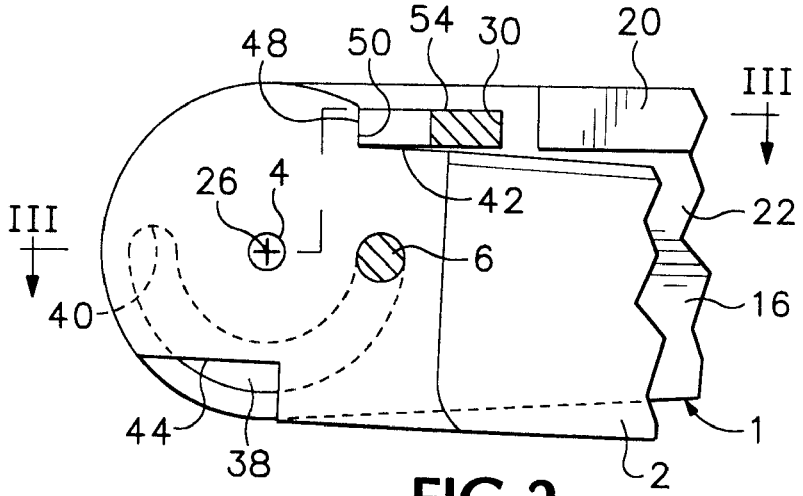
FIG. 2 is a section view taken in the same direction as FIG. 1, but showing the knife blade held in a closed position by a locking mechanism according to the invention.
Figure 3:
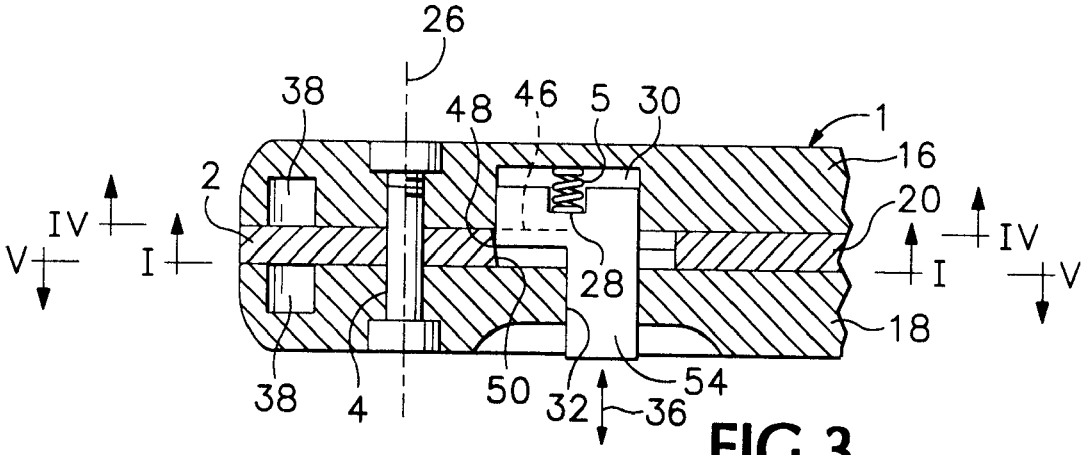
FIG. 3 is a section view of a portion of the knife shown in FIG. 2, taken along line III—III of FIG. 2.

Referring to the drawings which form a part of the disclosure, and referring first to FIGS. 1–3, a knife 14 including a locking mechanism which is one preferred embodiment of the present invention includes a handle 1 having a pair of opposite sides, a far side 16 and a near side 18. A central spacer or spine 20 is located between the sides 16 and 18, spacing them apart to form a groove 22. The spine 20 may be integral with one of the sides 16 and 18 or part of it may be formed together with each side 16 and 18. A blade 2 is attached to the handle 1 by a pivot pin 4 which extends through the sides 10 and 12 of the handle 1 and through a pivot hole 24 defined in a base portion of the blade 2, to define a blade pivot axis 26.

A locking body 3 has flat top and bottom sides parallel with each other and in plan view has generally the shape of an "L", as shown in FIG. 3. A notch 28 in one end of the locking body 3 receives an end of a compression spring 5, while the opposite end of the spring is supported by an interior surface of a cavity 30 defined in the far side 16 of the handle 1. The locking body 3 is fitted snugly in the cavity 30 defined in the side 16 and in a hole 32 defined in the side 18 of the handle 1 and is free to slide transversely in the handle 1 in the directions indicated by the arrow 36. As seen in section in a plane parallel with the blade 2, the locking body 3 preferably has the shape of a parallelepiped, and in particular a rectangle, as can be seen in FIGS. 1 and 2.

Figure 4:
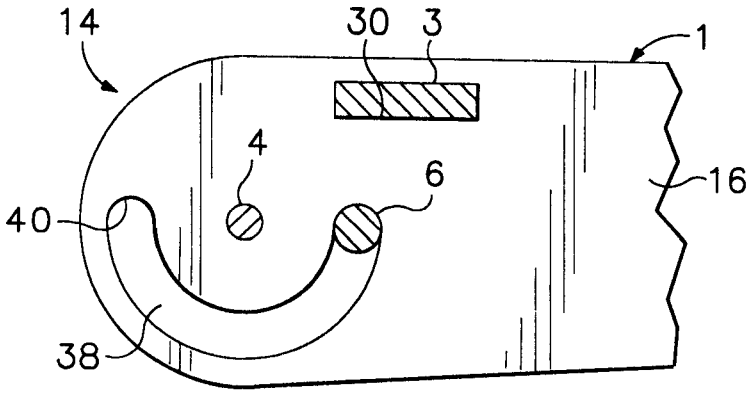
FIG. 4 is a view of one side of the portion of knife shown in FIGS. 1–3 taken in the direction of the line IV—IV in FIG. 3.
Figure 5:
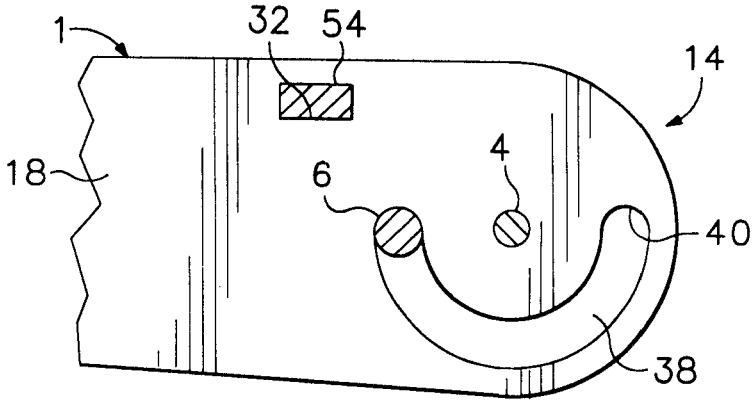
FIG. 5 is a view of the other side of the portion of a knife shown in FIGS. 1–3, taken in the direction indicated by line V—V in FIG. 3.

A stop 6 protrudes laterally from at least one side and preferably each side of the blade 2 into a respective opening, preferably in the form of a semicircular groove or slot 38, defined in the sides 16 and 18 of the handle 1, as may be seen best in FIGS. 4 and 5. When the blade 2 is fully extended with respect to the handle 1, the stop 6 rests on an inner surface 40 at the outer end of each semi-circular slot 38, and a locking face 42 on the bottom side of the locking body 3 rests against an engagement surface 44 of an upper rear part of the base portion of the blade 2, as shown in FIG. 1. The locking body 3 thus obstructs the base portion of the blade 2, holding the blade 2 in its extended position with respect to the handle 1, while the stop 6 and the surfaces 40 of the slots 38 prevent the blade 2 from moving further outward about the pivot axis 26 beyond its proper extended position as shown in FIG. 1. The stop 6 may, for example, be a pin or peg securely mounted in a corresponding hole in the blade 2 so as to extend laterally from each side of the blade 2.

To release the blade 2 so that it can be pivoted about the pivot shaft 4 from the extended position shown in FIG. 1 to the folded position shown in FIG. 2, the outer end, or bottom end as shown in FIG. 3, of the locking body 3 is pushed into the handle 1, toward the far side 16, overcoming the force of the spring 5 until the locking body 3 moves far enough to remove the locking face 42 from the path of the base of the blade 2, as shown by the broken line at 46, so that the base portion of the blade 2 can swing past the locking body 3.

When the blade 2 is rotated about the pivot shaft 4 to its folded position shown in FIG. 2 the stop 6 is moved to the opposite end of the semicircular grooves or slots 38, as shown in FIG. 2, so that the slots 38 and the stop 6 prevent the blade 2 from being pushed too far into the groove 22 between the sides 16 and 18 of the handle 1. At the same time, the locking body 3 is urged toward the side 18 of the handle 1 by the spring 5, bringing a retention face 48 of the locking body 3 into contact against a retainer surface 50 of the base portion of the blade 2, as shown in FIG. 2. The retention face 48 and the retainer surface 50, cooperating with the stop 6 and the semi-circular grooves or slots 38 thus keep the blade 2 in the folded position with respect to the handle 1.

In the embodiment of the invention shown in FIGS. 1–5, the side parts 16 and 18 of the handle 1 are separate parts, with the far side 16 defining the cavity 30 that retains the spring 5 and also guides the locking body 3, allowing it to move reciprocally in a transverse direction with respect to the handle 1, but preventing it from twisting or turning about an axis parallel with the pivot axis 26. The hole or slot 32 extends completely through the near side 18 of the handle 1. The hole 32 is smaller than the cavity 30, and corresponds in size with the smaller portion 54 of the locking body 3 that extends through the near side portion 18 of the handle 1, to guide it.

The materials used for the handle 1, the blade 2, the locking body 3, the blade pivot shaft 4, and the retaining stop 6 preferably are tempered or hardened appropriately to resist wear and insure that the locking mechanism of the present invention is durable and longlasting. To resist corrosion, the spring 5 may be made from stainless steel. Preferably, the sides 16 and 18 of the handle 1 may be manufactured using numerically controlled machining techniques such as electro-erosion or laser cutting.

Figure 6:
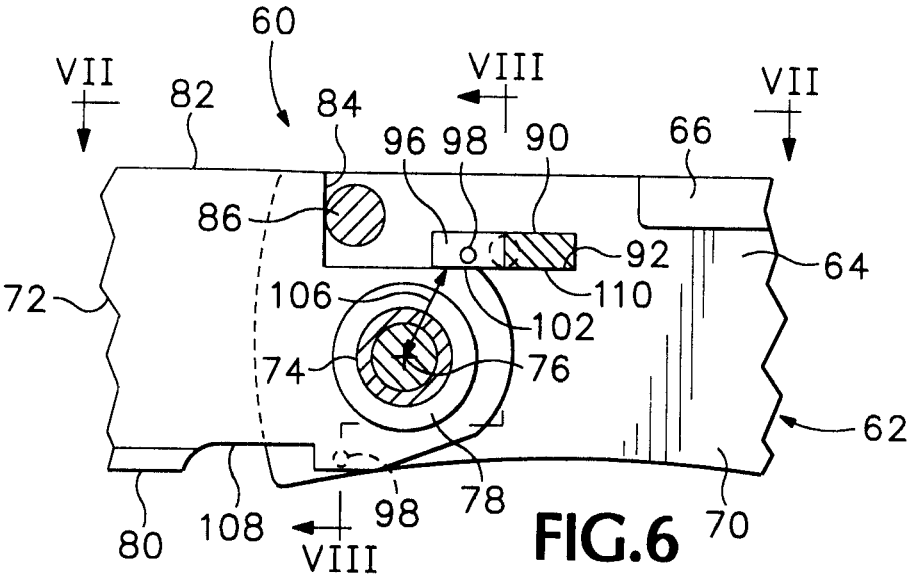
FIG. 6 is a view taken in a direction corresponding to that of FIG. 1, showing a folding knife including a blade locking mechanism which is a different embodiment of the present invention, with the blade in the open, or extended, position.
Figure 7:
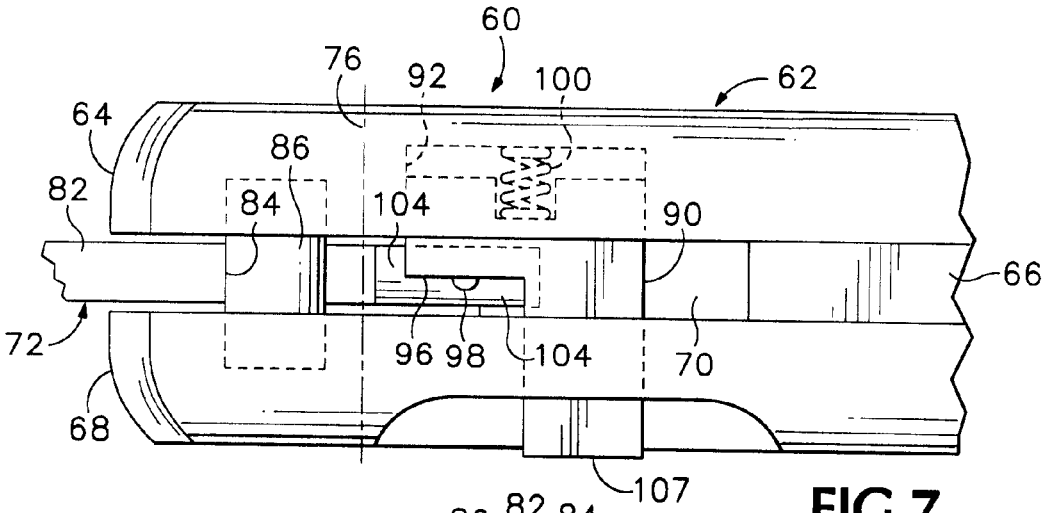
FIG. 7 is a detail view of the knife shown in FIG. 6, at an enlarged scale, taken in the direction of the line VII—VII and showing the locking mechanism engaged to hold the blade extended.

Referring next to FIGS. 6–10, and particularly FIG. 6, a folding knife 60 has a handle 62 including a far side part 64, shown in FIG. 6 together with a center spacer or spine 66. Part of a near side 68 of the handle 62 is shown in FIG. 7. Between the far side 64 and the near side 68, a cavity or groove 70 is defined. Within the groove 70 is the base portion of a blade 72 which is moveable with respect to the handle 62 about a pivot pin 74, which may be constructed as mating male and female threaded parts, or other conventional pivot shaft construction may be used. The pivot pin 74 defines a blade pivot axis 76. A pair of thin washers 78 are located on the pivot pin 74, one on each side of the base portion of blade 72, as spacers to locate the blade 72. The blade 72 has a sharpened edge 80, a back 82, and a backstop 84 which rests against a surface of an abutment pin 86 held by and extending transversely between the far side 64 and near side 68 of the handle 62, stopping the movement of the blade 72 outward about the axis 76 at the extended position shown in FIG. 6.

Figure 8:
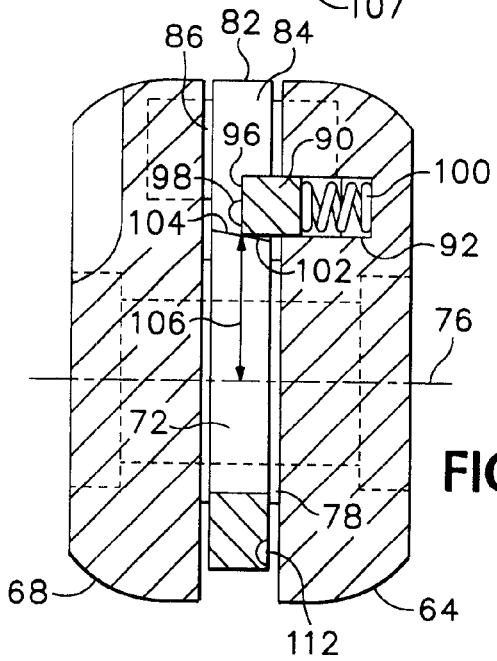
FIG. 8 is a section view of the knife shown in FIG. 6, at an enlarged scale, taken in the direction of the line VIII—VIII and showing an inclined lock engagement face of the blade of the knife.

A locking body 90, which in many ways is similar to the locking body 3, is carried in the handle 62 and moveable slidably in a transverse direction, as shown best in FIG. 7. The locking body 90 is held in respective locking body holes: a cavity 92 is defined in the far side 64 of the handle 62, and a through hole 94 is defined in the near side 68. As shown in FIGS. 7 and 8, a detent face 96 of the locking body 90 includes a protrusion, preferably a small hardened steel ball 98, mounted in the locking body 90 so that it protrudes a small distance laterally outward from the detent face 96, toward the near side 68 of the handle 62. A spring 100, which may be similar to the spring 5 of the knife 10, is located in the cavity 92 and urges the locking body 90 toward the near side 68.

With the blade 72 in its extended position as shown in FIG. 6, a flat locking face 102 of the locking body 90 is urged into contact with an engagement surface 104 of an upper rear part of the base of the blade 72 as shown in FIG. 7. The engagement surface 104 is preferably inclined slightly toward the far side 64 of the handle 62, so that as the locking body 90 follows its transverse path of movement, guided by the locking body holes 92 and 94, the locking face 102 approaches and contacts the engagement surface 104 and attempts to cam the engagement surface 104 downward. Such camming action urges the blade 72 to rotate about its pivot axis 76 in a direction bringing the backstop 84 toward the abutment pin 86, to hold the blade 72 locked securely in its extended position as shown in FIG. 6.

Since the locking body 90 is supported snugly but slidably in both of the locking body holes 92 and 94, in the far side 64 and the near side 68 of the handle 62, the locking mechanism according to the present invention keeps the blade 72 securely in the extended position, with an amply long lever arm 106 defined between the blade pivot axis 76 and the location where the locking face 102 rests on the engagement surface 104. Since the locking body 90, similar to the locking body 3, has parallel flat top and bottom surfaces, the locking body 90 is free to slide transversely against the force of the spring 100 when the outer end 107 is pushed into the handle 62, toward its far side 64. When the locking body 90 is pushed far enough toward the far side 64, the locking face 102 and the detent face 96 and ball 98 move beyond the engagement surface 104, giving clearance for the blade 72 to rotate about the pivot pin 74 toward its folded position shown in FIG. 9.

Figure 9:
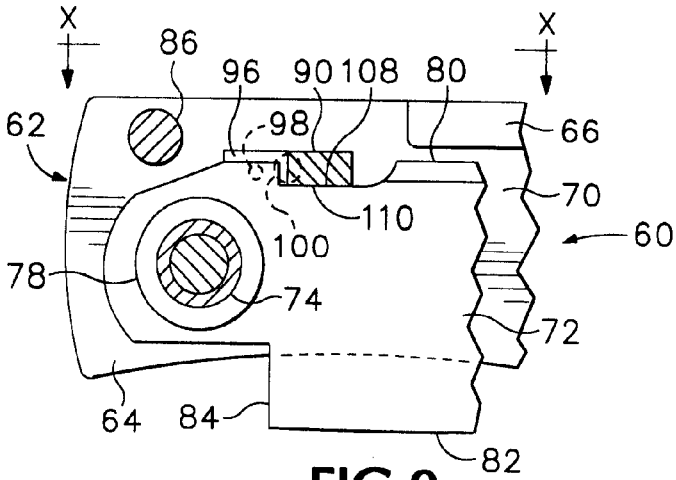
FIG. 9 is a view taken in a direction corresponding to that of FIG. 2, showing a portion of the knife shown in FIG. 6 at an enlarged scale, with its blade folded.
Figure 10:
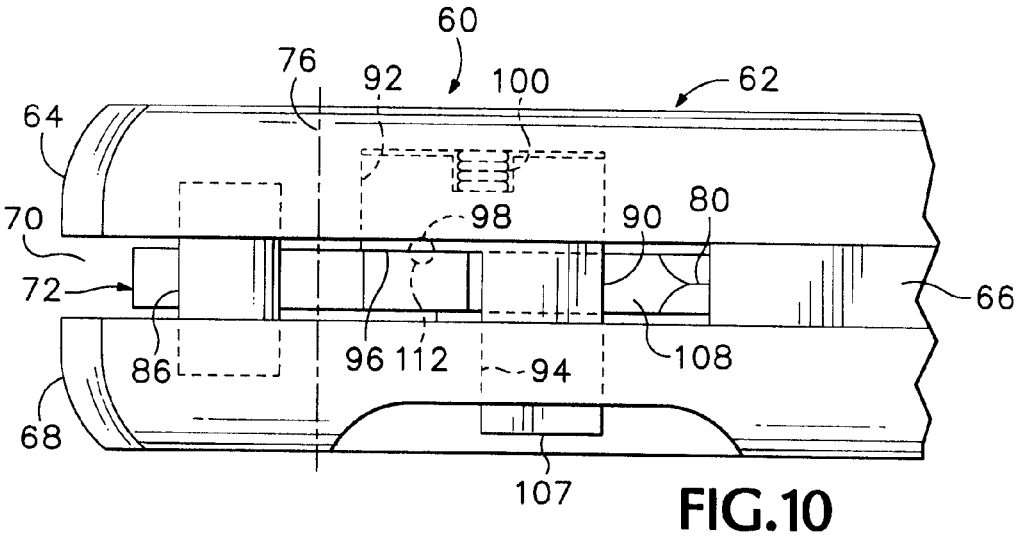
FIG. 10 is a detail view of the portion of a knife shown in FIG. 9, taken in the direction of the line X—X and showing a detent holding the blade of the knife in its folded position.

With the blade 72 of the folding knife 60 in its folded position as shown in FIGS. 9 and 10, a limiting surface 108, on the bottom of the base portion of the blade 72, is adjacent to a bottom surface 110 of the narrower portion of the locking body 90. The locking body 90 thus blocks the blade 72 from being moved further into the groove 70 and prevents the sharp edge 80 from being damaged by contact against the center spacer, or spine 66, of the handle 62.

The blade 72 is retained in the folded position shown in FIGS. 9 and 10 by the engagement of the detent ball 98 in a detent cavity 112 shown in FIG. 8, defined in the side of the blade 72 directed toward the detent face 96 of the locking body 90. The detent ball 98 is kept engaged in the cavity 112 by the force of the spring 100, as it urges the locking body 90 outward toward the near side 68 of the handle 62. This provides sufficient security for ordinary handling of the knife 60 with the blade 72 in its folded position, but the detent mechanism can be overcome, camming the detent ball 98 out of the cavity 112, by manually moving the blade 72 away from its folded position. In one embodiment of the invention the detent ball 98 is about 0.4 mm in diameter and is pressed into a hole in the detent face 96 with an interference fit, while the cavity 112 is about 0.38 mm in diameter.

Figure 11:
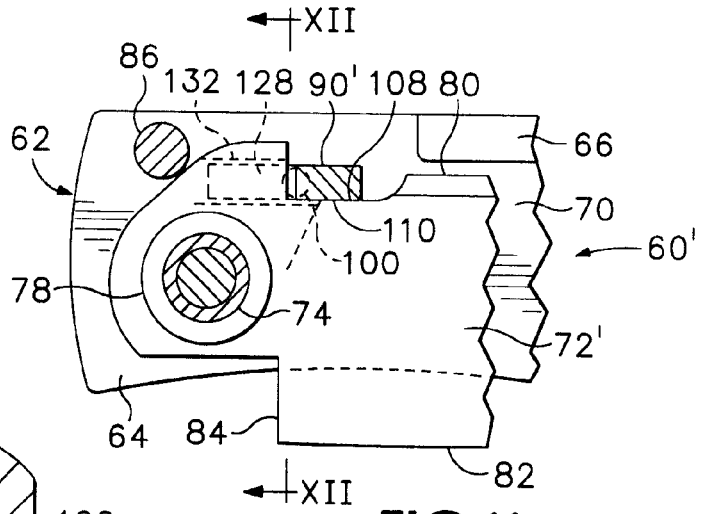
FIG. 11 is a view similar to FIG. 9, but showing a different detent mechanism for holding the blade in its folded position.

A somewhat different detent mechanism, depicted in FIGS. 11, 12, 13, and 14, is utilized in a knife 60', which in most ways is similar to the knife 60. Corresponding reference numerals are therefore used in FIGS. 11–14, except where the knife 60' differs from the knife 60. A blade 72' of the knife 60' is retained in its folded position, as shown in FIG. 11, by camming action of a detent face 128 of a locking body 90' and an inwardly inclined detent camming surface 132 on the adjacent side 134 of the blade 72'. The locking body 90' is shown separately in FIG. 13, where the inclination of the detent face 128 is clearly shown.

Figure 14:
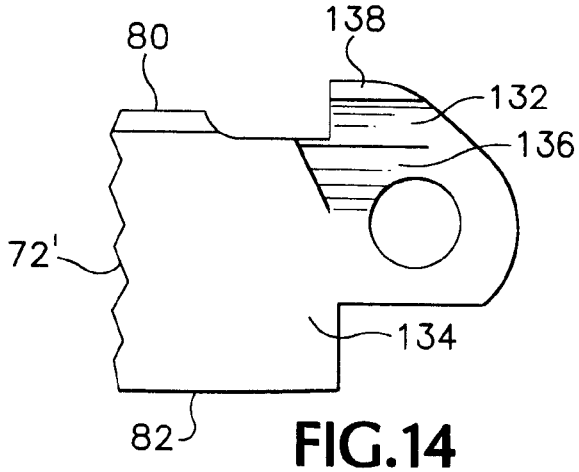
FIG. 14 is a side elevational view, taken in the direction indicated by the line XIV—XIV in FIG. 12, showing the blade of the knife shown in FIGS. 11–13.

Preferably, a surface 136, located below the inclined detent camming surface 132, as seen in FIG. 14, is inclined outward, toward the face of the side 134 of the blade 72', to facilitate formation of the inclined detent camming surface 132. An additional inclined surface 138 extends from the inclined detent camming surface 132 toward an outer margin of the blade, as shown in FIGS. 12 and 14, to facilitate closing the blade by camming the locking body 90' away from the blade 72', into the cavity 92, as the blade 72' is pushed toward its folded position shown in FIGS. 11 and 12.

Figure 12:
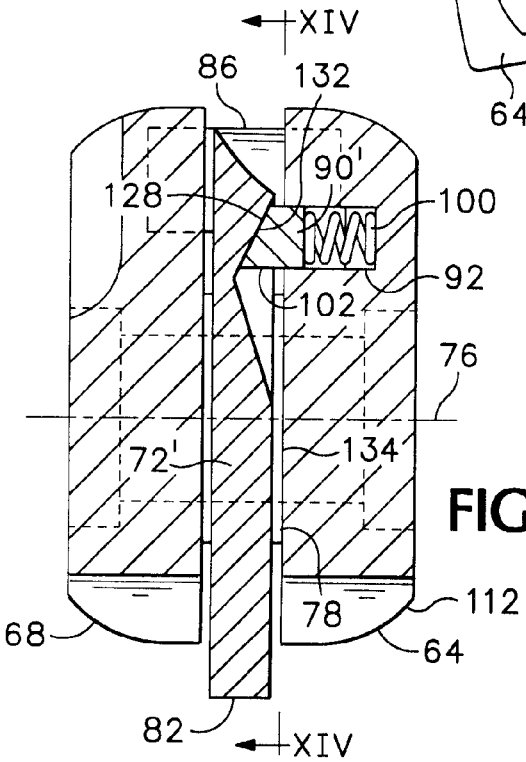
FIG. 12 is a section view of the knife shown in FIG. 11, at an enlarged scale, taken in the direction of the line XII—XII.
Figure 13:
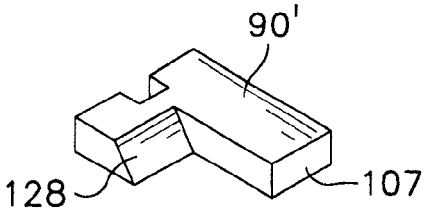
FIG. 13 is a perspective view of the locking body of the locking mechanism shown in FIGS. 11 and 12.

The detent mechanism shown in FIGS. 11–14 permits the blade 72' to be moved away from its folded position simply by manually moving the blade 72' with respect to the handle 62. The interaction of the inclined detent camming surface 132 against the detent face 128 urges the locking body 90' away from the blade 72' into the cavity 92. When the blade 72' is not actively urged away from its folded position, the detent mechanism ordinarily keeps the blade 72' in its folded position as shown in FIGS. 11 and 12.

Figure 15:
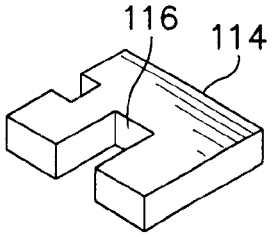
FIG. 15 is a perspective view of a locking body useful in a locking mechanism that is an alternative embodiment of the present invention.

While the locking body 3 and the locking body 90 are both L-shaped, a suitable alternative locking body 114 shown in FIG. 15 is of generally similar construction of flat plate material in the shape of a defined by a notch 116 that is aligned with the base portion of the blade of a tool such as the folding knives 14 and 60 when such a locking body 114 is moved to its releasing position in the handle of such a folding tool. Such a locking body 114 requires locking body holes of the same size in both sides of the handle of such a tool, to support the locking body 114 and allow it to slide laterally with respect to the handle, between its locking position and its releasing position.

It should be recognized that other parallelepiped shapes besides the generally rectangular shape illustrated previously may be utilized and may be preferable in some cases because of manufacturing requirements, and thus a generally "L"-shaped locking body 142 has arcuately rounded margins 144, 146, 148 extending longitudinally of the locking body 142, that is, in a direction that would be transverse with respect to the handle of a knife or other tool in which such a locking body 142 is used. Of course, such a locking body 142 would require a correspondingly shaped cavity and through-hole in the handle in which such a locking body 142 is used. Such a locking body 142 would function otherwise in the same manner as does the locking body 3 described previously.

Figure 16A:
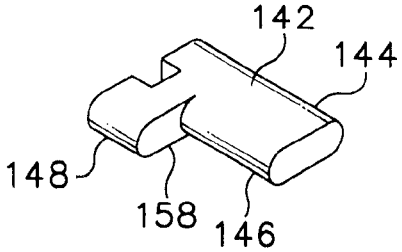
FIGS. 16*a* and 16*b* are perspective views of additional locking bodies having a different parallelepiped shape, useful in locking mechanisms embodying the present invention.
Figure 16B:
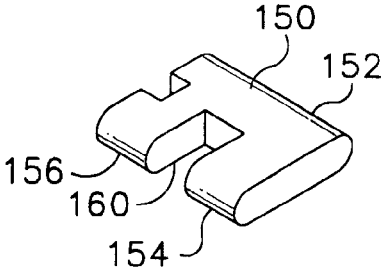

A locking body 150, shown in FIG. 16*b*, is similar to the "U"-shaped locking body 114 shown in FIG. 15, except that it, too, has arcuately rounded margins 152, 154, and 156 interconnecting its top and bottom surfaces.

The locking bodies 142 and 150 have flat bottom surfaces parallel with flat upper surfaces and thus define flat locking faces 158 and 160, whose leading edges are shown in FIGS. 16*a* and 16*b*.

Figure 17:
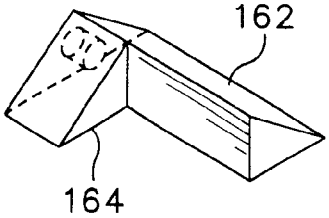
FIG. 17 is a perspective view of another alternative shape for a parallelepiped locking body useful in a locking mechanism according to the present invention.

Yet a further possible parallelepiped shape for a locking body in accordance with the present invention is shown in FIG. 17, where a locking body 162 has a triangular cross-sectional shape while having a flat bottom surface defining a locking face 164 whose leading edge is shown in FIG. 17. It will be understood that a correspondingly triangular "U"-shaped locking body could also be used in accordance with the invention.

Figure 18:
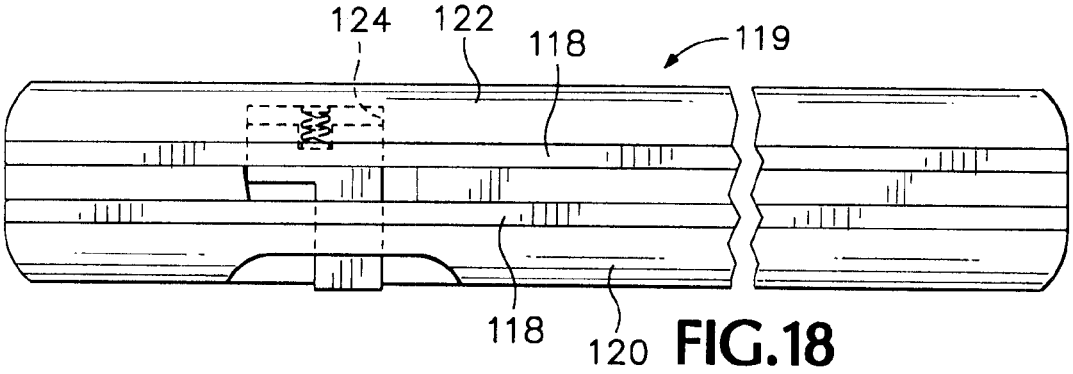
FIG. 18 is a top plan view of a folded knife embodying the present invention.

As shown in FIG. 18, a knife according to the present invention need not have a handle whose sides are monolithic as are sides 16 and 18 of the knife 14. Instead, handle liner plates 118 of a knife 119 including a locking mechanism embodying the present invention, shown with its blade folded, may be of suitably thick and strong steel or other metal. Outer scales 120 and 122 may be of more decorative material. The scale 122 may define a cavity 124, to retain a spring included as part of the locking mechanism, or other suitable structure may be provided in the handle to support a spring of the same or a different type to urge the locking body laterally toward its locking position with respect to the handle.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A folding tool comprising:

(a) a handle having a back and a pair of sides and defining a groove between said sides;

(b) a blade mounted on the handle and moveable about a pivot axis, between a folded position and an extended position with respect to the handle, said blade having a base portion and a transversely extending flat engagement surface located on said base portion and spaced apart from said pivot axis;

(c) a pair of locking body holes located between said back and said pivot axis and aligned transversely opposite each other, each of said sides defining a respective one of said locking body holes; and (d) a locking body disposed in said locking body holes and extending transversely between said sides of said handle, said locking body being slidable transversely with respect to said handle between a releasing position and a locking position, and said locking body having a substantially flat locking face resting on said engagement surface when said locking body is in said locking position.

2. The folding tool of claim 1, said base portion of said blade including a laterally protruding stop and one of said sides of said handle defining an opening facing toward said groove, said stop extending into said opening, said opening being defined by an inner surface and said stop contacting said inner surface, said opening thereby limiting the extent to which said blade is moveable about said pivot axis.

3. The folding tool of claim 2 wherein said opening is a semicircular groove.

4. The folding tool of claim 2 wherein said opening and said stop establish said extended position of said blade with respect to said handle.

5. The folding tool of claim 2 wherein said opening and said stop establish said folded position of said blade with respect to said handle.

6. The folding tool of claim 1 wherein said locking body is a parallelepiped in its section shape.

7. The folding tool of claim 6 wherein said locking body is rectangular in its section shape in a plane parallel with said blade.

8. The folding tool of claim 6 wherein said locking body has flat top and bottom surfaces and arcuately rounded surfaces interconnecting said top and bottom surfaces.

9. The folding tool of claim 6 wherein said locking body has a flat locking face and is triangular in its section shape in a plane parallel with said blade.

10. The folding tool of claim 1 including a spring located in said handle and urging said locking body toward said locking position thereof.

11. The folding tool of claim 1 wherein said locking body has a path of movement with respect to said handle and said engagement surface of said base of said blade is inclined with respect to said path of movement, whereby said locking face approaches said engagement surface as said locking body moves along said path of movement.

12. The folding tool of claim 1 wherein said locking body is L-shaped.

13. The folding tool of claim 1 wherein said locking body is U-shaped.

14. The folding tool of claim 1, said blade having a retainer surface and said locking body having a retention face resting against said retainer surface when said blade is in said folded position and said locking body is in said locking position, whereby said locking body locks said blade in said folded position.

15. The folding tool of claim 14 wherein said retention face is perpendicular to said locking face of said locking body.

16. The folding tool of claim 15 including a spring held in said handle and urging said locking body toward said locking position.

17. The folding tool of claim 1, said blade including a backstop portion and said handle including an abutment, said backstop portion of said blade resting in contact with said abutment when said blade is in said extended position.

18. The folding tool of claim 17 wherein said abutment is a member extending transversely between said sides of said handle.

19. The folding tool of claim 1, said blade having a limiting surface located adjacent said locking body when said blade is in said folded position, said locking body thereby preventing said blade from moving too far into said groove.

20. The folding tool of claim 1, said locking body and said blade having mating parts of a ball detent engaged with each other when said blade is in said folded position.

21. The folding tool of claim 20 including a spring held in said handle, wherein said blade defines a detent cavity and said locking body has a detent ball carried thereon, said detent ball projecting into said detent cavity and being urged toward said blade by said spring when said blade is in said folded position with respect to said handle.

22. A folding tool comprising:

(a) a handle having a back and a pair of sides and defining a groove between said sides;

(b) a blade mounted on the handle and moveable about a pivot axis, between a folded position and an extended position with respect to the handle, said blade having a base portion and a transversely extending flat engagement surface located on said base portion and spaced apart from said pivot axis, said engagement surface facing said back when said blade is in said extended position;

(c) a pair of locking body holes aligned transversely opposite each other, each of said sides defining a respective one of said locking body holes; and (d) a locking body disposed in said locking body holes and extending transversely between said sides of said handle, said locking body being slidable transversely with respect to said handle between a releasing position and a locking position, and said locking body having a substantially flat locking face resting on said engagement surface when said locking body is in said locking position.

23. The folding tool of claim 22, said base portion of said blade including a laterally protruding stop and one of said sides of said handle defining an opening facing toward said groove, said stop extending into said opening, said opening being defined by an inner surface and said stop contacting said inner surface, said opening thereby limiting the extent to which said blade is moveable about said pivot axis.

24. The folding tool of claim 23 wherein said opening is a semicircular groove.

25. The folding tool of claim 23 wherein said opening and said stop establish said extended position of said blade with respect to said handle.

26. The folding tool of claim 23 wherein said opening and said stop establish said folded position of said blade with respect to said handle.

27. The folding tool of claim 22 wherein said locking body is a parallelepiped in its section shape.

28. The folding tool of claim 27 wherein said locking body is rectangular in its section shape in a plane parallel with said blade.

29. The folding tool of claim 27 wherein said locking body has flat top and bottom surfaces and arcuately rounded surfaces interconnecting said top and bottom surfaces.

30. The folding tool of claim 27 wherein said locking body has a flat locking face and is triangular in its section shape in a plane parallel with said blade.

31. The folding tool of claim 22 including a spring located in said handle and urging said locking body toward said locking position thereof.

32. The folding tool of claim 22 wherein said locking body has a path of movement with respect to said handle and said engagement surface of said base of said blade is inclined with respect to said path of movement, whereby said locking face approaches said engagement surface as said locking body moves along said path of movement.

33. The folding tool of claim 22 wherein said locking body is L-shaped.

34. The folding tool of claim 22 wherein said locking body is U-shaped.

35. The folding tool of claim 22, said blade having a retainer surface and said locking body having a retention face resting against said retainer surface when said blade is in said folded position and said locking body is in said locking position, whereby said locking body locks said blade in said folded position.

36. The folding tool of claim 35 wherein said retention face is perpendicular to said locking face of said locking body.

37. The folding tool of claim 36 including a spring held in said handle and urging said locking body toward said locking position.

38. The folding tool of claim 22, said blade including a backstop portion and said handle including an abutment, said backstop portion of said blade resting in contact with said abutment when said blade is in said extended position.

39. The folding tool of claim 38 wherein said abutment is a member extending transversely between said sides of said handle.

40. The folding tool of claim 22, said blade having a limiting surface located adjacent said locking body when said blade is in said folded position, said locking body thereby preventing said blade from moving too far into said groove.

41. The folding tool of claim 22, said locking body and said blade having mating parts of a ball detent engaged with each other when said blade is in said folded position.

42. The folding tool of claim 41 including a spring held in said handle, wherein said blade defines a detent cavity and said locking body has a detent ball carried thereon, said detent ball projecting into said detent cavity and being urged toward said blade by said spring when said blade is in said folded position with respect to said handle.

* * * * *

UNITED STATES PATENT AND TRADEMARK OFFICE

CERTIFICATE OF CORRECTION

PATENT NO. : 6,430,816 B2
DATED : August 13, 2002
INVENTOR(S) : Yves Neveux

It is certified that error appears in the above-identified patent and that said Letters Patent is hereby corrected as shown below:

Column 6,
Line 21, insert the capital letter -- U -- preceding the word “defined”.

Signed and Sealed this

Nineteenth Day of October, 2004

JON W. DUDAS
*Director of the United States Patent and Trademark Office*